United States Patent [19]

Coty

[11] 4,226,054

[45] Oct. 7, 1980

[54] PARTICLE COLLECTION SYSTEM

[76] Inventor: David Coty, 9229 E. Prairie, Skokie, Ill. 60203

[21] Appl. No.: 898,161

[22] Filed: Apr. 20, 1978

Related U.S. Application Data

[63] Continuation-in-part of Ser. No. 770,993, Feb. 22, 1977, abandoned.

[51] Int. Cl.[2] ..... E05F 13/00

[52] U.S. Cl. ..... 51/270; 51/273

[58] Field of Search ..... 15/347; 51/270, 273

[56] References Cited

U.S. PATENT DOCUMENTS

| | | | |
|---|---|---|---|
| 1,890,675 | 12/1932 | Doerr et al. | 51/270 X |
| 2,347,334 | 4/1944 | Schmieg | 51/273 X |
| 2,773,337 | 12/1956 | DeMarchi | 51/273 X |
| 3,126,021 | 3/1964 | May | 51/273 X |
| 3,525,183 | 8/1970 | Gargrave | 51/270 |
| 4,047,913 | 9/1977 | Okumura | 51/273 X |
| 4,124,956 | 11/1978 | Levinson | 51/273 |

*Primary Examiner*—James G. Smith
*Attorney, Agent, or Firm*—Alter and Weiss

[57] ABSTRACT

A particle collector for intercepting and collecting small particles dislodged during grinding operations utilizes a vacuum unit to trap particles within a collection bag. Uniquely formed intake nozzles provide effective particle pickup for both bench-type and hand-held grinding units. The nozzles may be interchanged without requiring the use of tools, and the collector may thus be conveniently switched from a bench-type grinder to a hand-held grinder.

The vacuum source is portable and housed in a cabinet uniquely designed for quiet operation and even airflow. Particles are collected in a reusable bag and may be processed to recover precious substances. The nozzle designed for use with bench-type grinders may be horizontally or vertically positioned, as required by work space limitations.

6 Claims, 15 Drawing Figures

PARTICLE COLLECTION SYSTEM

This is a Continuation-in-Part of my earlier application, Ser. No. 770,993, filed Feb. 22, 1977, and since abandoned.

This application relates generally to particle collectors, and more particularly to a vacuum-powered system to collect dust and particles dislodged by hand-held, or bench-type grinders during grinding operations.

Grinders of the type frequently used by, for example, dentists, or jewelers, are of particular value in shaping and polishing small work articles, such as articles of jewelry or dental appliances. Work pieces made from materials such as wood or plaster are sometimes annoying and dangerous to grind, because by its very nature, grinding dislodges particles in the form of dust, or may even cause particles to fly off which are large enough to cause serious injury to the eyes. Inhaling such dust particles may also, over a period of years, lead to chronic lung discomfort, which may eventually necessitate medical treatment. When precious or semi-precious metals are being ground, the metal dust so created is dissipated and eventually lost. Dental workpieces, in particular, must be ground to leave a minimum collection of dust and particles behind, because such workpieces are often intended to be used in a patient's mouth. Therefore, the need exists for a collector which will not only protect the grinder operator, but which will make possible the reclamation of minute particles of precious material.

Prior attempts at collecting and trapping particles dislodged by grinding have not been entirely successful. Devices such as are shown in U.S. Pat. Nos. 3,126,021 and 2,773,337 position the vacuum port some distance from the work site, resulting in less efficient particle pickup. Others, such those shown in U.S. Pat. Nos. 3,585,980, 3,882,644, and 3,862,521 are bulky, unwieldy, and not designed to allow close work with small, hand-held grinders, while picking up and eliminating particles which, even if present in small amounts, could cause serious lung disorders.

Collectors used in the past removed approximately 20 percent of the dust and particles dislodged during grinding. However, because of the highly toxic effects of such materials as gold, ceramics, plastics, precious and non-precious metals, beryllium, and cadmium, at least 90 percent of the particles dislodged must be removed in order to provide safety for the technicians in the laboratory, according to regulations set forth by the Occupational Safety and Health Act. Therefore, the strength and effectiveness with which the vacuum collector system traps such particles is of critical importance.

As stated in the Dental Laboratories OSHA Manual published by the Illinois Dental Laboratories Association, sub-part G-Occupational Health and Environmental Control:

"Air Contaminants: Employees' exposure to certain materials in the air must be controlled and limited to below levels specified in the Standards. Ventilation: Local exhaust ventilation is a basic engineered means for reducing the concentrations of air contaminants in the breathing zone of the employee. Such ventilation systems must incorporate proper hood design, proper capture velocity (as specified in ANSI Standard referenced later) adequate make-up air, and electrical wiring suitable for the location. It should eliminate or minimize the need for personal protective equipment . . . Local exhaust ventilation is required if toxic materials or prosthetic appliances potentially contaminated with microorganisms are involved . . . Ventilation systems should be designed in accordance with the Fundamental Government Design and Operation of Local Exhaust Systems." ANSI Standard Z 9.2-1971.

These standards set specifications for hood enclosures and the volume of air sufficient to capture and remove air-borne particles at their point of generation. The exhaust inlet enclosure should maintain air flow in the same direction as that along which the particles are propelled by the tools, should be shaped to intercept substantially all particles, and should be positioned as close to the point of generation as practical.

Another important consideration, particularly in the genre of the Dental Laboratory is that a large number of dental technicians may simultaneously be conducting grinding operations. Even if the dust raised by a single grinding operation is found to be of minimal consequence, multiplying this amount of dust by 15 or 20 individual technicians may present an even more serious hazard to both health and equipment.

Prior attempts to create and modify a vacuum collection system for use in a dental laboratory setting have met with limited success. The vacuum units themselves are often extremely large and noisy, and for this reason may be placed in another room entirely, while a central vacuum hose or duct is run to the individual work stations at which grinders are positioned. This system has many obvious disadvantages, including the complexity and inflexibility of installation. Grinders must be positioned wherever a tap to the central vacuum duct is available. Extensive installation is required to run such ducts to benches or other work areas frequently used for grinding. Other vacuum units, designed to be used at a single work site, are noisy and inefficient when called upon to collect the fine, potentially hazardous particles prevalent during the grinding of such materials as cadmium and beryllium.

Cadmium is used in volatile backings in dental laboratories, and is removed by burn-out. Cadmium fumes and dust are highly toxic. Exhausters must capture the material at its point of release to keep the fumes or dust out of the breathing zone of laboratory personnel. Beryllium is a highly hazardous metal that has found acceptance as a component of non-precious alloy systems for dental devices. The principal hazard of beryllium, and its effect on the lungs caused by inhalation of excessive concentrations in the air, has been confirmed.

The following table lists other materials for which maximum allowable concentrations in the air have been established by OSHA.

MAXIMUM ALLOWABLE CONCENTRATION FOR AIR CONTAMINANTS

| Substance | Parts per Million-Parts of Air, ppm. | Milligrams per Cubic Meter, mg/m3 |
|---|---|---|
| Acetic acid | 10 | 25 |
| Acetone | 1.000 | 2400 |
| Antimony & compounds | | 0.5 |
| Ammonia | 50 | 35 |
| Benzene | 10 | |
| Benzoyl peroxide | | 5 |

-continued

MAXIMUM ALLOWABLE CONCENTRATION FOR AIR CONTAMINANTS

| Substance | Parts per Million-Parts of Air, ppm. | Milligrams per Cubic Meter, mg/m3 |
|---|---|---|
| Benzyl chloride | 1 | 5 |
| Beryllium & beryllium compounds | | 0.002 |
| Cadmium dust (as Cd) | | 0.2 |
| Cadmium fume (as Cd) | | 0.1 |
| Carbon monoxide | 50 | 55 |
| Carbon tetrachloride | 10 | |
| Chloroform | 50 | 240 |
| Chromic acid and chromates | | 0.1 |
| Cobalt, metal fume, & dust | | 0.1 |
| Cresol (all isomers) -(Skin)* | 5 | 22 |
| Cyanide (as CN) - (Skin)* | | 5 |
| Ethyl alcohol | 1000 | 1900 |
| Ethyl chloride | 1000 | 2600 |
| Ethyl ether | 400 | 1200 |
| Ethyl Silicate | 100 | 850 |
| Ethylene oxide | 50 | 90 |
| Fluoride (as F) | | 2.5 |
| Formaldehyde | 3 | |
| Hydrogen fluoride | 3 | 2 |
| Hydrogen chloride | 5 | 7 |
| Hydrogen peroxide (90%) | 1 | 1.4 |
| Isopropyl alcohol | 400 | 980 |
| L.P.G. (Liquified Petroleum Gas) | 1000 | 1800 |
| Mercury | | 0.1 |
| Methyl alcohol (methanol) | 200 | 260 |
| Methylene chloride | 500 | |
| Methyl ethyl ketone (MEK) (2-Bulanone) | 200 | 590 |
| Methyl methacrylate | 100 | 410 |
| Nitric acid | 2 | 5 |
| Nitroglycerine - (Skin)* | 0.2 | 2 |
| Ozone | 0.1 | 0.2 |
| Phenol - Skin* | 5 | 19 |
| Phosphoric acid | | 1 |
| Picric acid - (Skin)* | | 0.1 |
| Silver metal and soluble compounds | | 0.01 |
| Stoddard solvent | 200 | 1150 |
| Sulphur dioxide | 5 | 13 |
| Sulphuric acid | | 1 |
| 1,1,1-trichloroethane(methyl chloroform) | 350 | 1900 |
| O-Toluidine - (Skin)* | 5 | 22 |
| Toluene | 200 | |
| Zic oxide fume | | 5 |

*The word skin after a material indicates that the material is readily absorbed through the skin and that exposure by this route requires consideration.

While the foregoing table may be less than exhaustive, it is a clear indication that effective particle collectors are no longer a laboratory luxury, but are required, by OSHA, to meet federally-set standards for collecting air-borne impurities in the laboratory. Efficient collection has self-apparent health considerations; such collectors also may be of economic import when reclamation of particles of precious metal, such as gold or platimum, is considered.

The present invention may be used with hand-held or bench-type grinders of the type having a rotating shaft with a grinding element mounted thereon. A preferred embodiment of the present invention includes a vacuum motor housing, within which are disposed an electric motor adapted to draw a vacuum therewithin, means to protect the motor from contamination by collected particles, a selectively removable trap for collecting particles, and a vacuum port, communicating with said trap, and constructed to receive a vacuum supply hose thereat. The housing includes selectively removable panels affording access to the motor elements and controls, and to the particle trap. The housing itself is designed to minimize motor noise, and to provide means for directing air flow through the housing without exposing the components disposed therewithin to excessive contamination.

In a preferred embodiment of the invention, the particle trap may be easily and conveniently removed from the housing to facilitate removal therefrom of trapped particles.

In a preferred embodiment of the invention, the vacuum supply line, heretofore mentioned, provides a short, direct connection between the housing and the individual collecting hoods. Preferably, hoods are provided adapted for use either with bench-type grinders, which are typically permanently attached to a work surface, or of otherwise limited portability, and to fit hand-held grinders used for close or fine work.

In a preferred embodiment of a collector nozzle to be used with bench-type grinders, the nozzle is cast to be free-standing, either in a vertical or horizontal position, and is placed proximate to the grinding element in order to maximize collection. The casting is formed with a smooth interior surface tapering to a vacuum port to which the vacuum supply hose is secured. The tapering of the hood is such that particles impacting the hood are deflected toward the vacuum port.

In a preferred embodiment of a nozzle designed to be used with hand-held grinders, the nozzle has a collector portion, shaped to deflect intercepted particles toward a vacuum port formed at its rear, and a series of mounting elements providing a clamp-type friction fit with the body of the grinder. In a second preferred embodiment, the hand nozzle is provided with a thumb screw threaded therethrough adapted to contact the grinder body. A series of cylindrical sleeves may be provided to fit grinder bodies of varying dimensions, and the hood may be sized and adapted to attach securely to each said sleeve.

The present invention has, therefore, the following objects:

To provide accessories for grinders adapted to protect the grinder operation from dust raised during grinding operations;

To provide such accessories in forms which do not impede access to the grinding elements;

To provide such accessories in forms adapted for use with either bench-type or hand-held type grinders;

To provide such accessories with vacuum collection of particles;

To provide such accessories in forms allowing for trapping and reclaiming particles;

To provide such accessories for use at individual work stations without requiring centrally installed vacuum sources;

To provide such accessories with collection nozzles adapted to be used with different types of grinders;

To provide such nozzles in forms readily interchangeable with the vacuum source of said accessories without requiring the use of tools;

To provide such accessories in forms drawing a strong, useful vacuum while minimizing motor noise and vibration commonly associated with vacuum units;

To provide such accessories in forms facilitating air flow through said vacuum unit while minimizng contamination of said units by dust, or the like; and To provide such accessories in forms simple and economical to manufacture and maintain.

These and further objects will become more apparent upon consideration of the accompanying drawings, in which.

Figure 1:
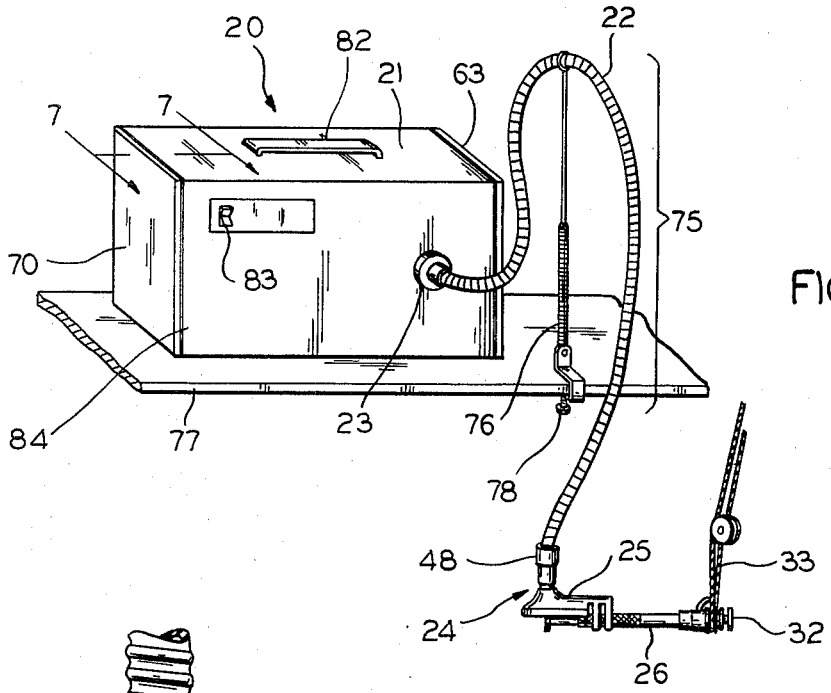
FIG. 1 is a perspective view of a preferred embodiment of the present invention.

Consistent with the foregoing objects, a collector 20 is provided having a cabinet 21 within which motor compartment 85 and vacuum compartment 54 are disposed. An electric motor draws air through said vacuum compartment, through cabinet vacuum port 23, and vacuum hose 22 to a vacuum nozzle 24 positionable at hand grinder 26 or bench grinder 28 for collection of particles. Hand nozzle 25 may be attached to hand grinder 20, while bench nozzle 27 is freestanding and may be placed or positioned as required. Hose 22 is interchangably attachable to hand nozzle 25 or bench nozzle 27, as required. Motor compartment 85 is closed off by end panel 70, which is spaced apart from cabinet 21 to provide airflow baffling. Vacuum compartment 54 houses collector bag 61, hand-removable from vacuum port 23 for disposal or recycling of collected particles. Hand nozzle 25 may be modified to include adjusting screw 40 and sleeves 41, allowing firm attachment of nozzle 25 to hand grinders of varying diameters.

Referring now to FIG. 1, the numeral 20 indicates generally a vacuum particle collector having a cabinet 21 to which one end of a vacuum line 22 is connected, at cabinet vacuum port 23. The other end of vacuum line 22 is connected to a collector nozzle, shown generally at 24. In the preferred embodiments discussed herein, collector nozzle 24 is disclosed in two preferred versions: detachable hand nozzle 25, attachable to such grinding implements as those exemplified by hand-held grinder 26, and free-standing bench nozzle 27, for use with grinding implements exemplified by bench-type grinder 28 in FIG. 3.

Figure 2:
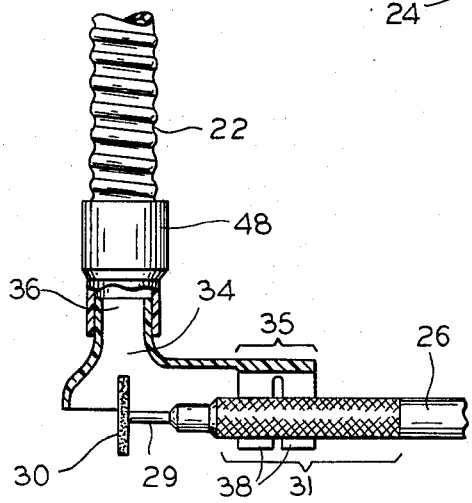
FIG. 2 is a partial side sectional view of the hand-held grinder and hand nozzle of FIG. 1.

Referring now to FIG. 2, it may be seen that hand-held grinder 26 exemplifies grinders of the type having a rotatable shaft 29 to which a grinding element 30 is affixed. Typically, such hand-held grinders have elongated body portions such as that shown at 31 in FIG. 2. Body 31 customarily forms a hand grip for the grinder operator and acts as a housing for shaft 29 as it extends rearward to connect to pulley 32, which, in turn, is driven by belt 33.

Figure 14:
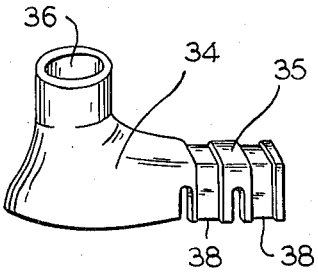
FIG. 14 is a perspective view of the hand nozzle.

Referring now to FIGS. 1, 2, and 14, a preferred embodiment of hand nozzle 25 includes a hollow head portion 34 integral with a solid body portion 35. Integral with and extending from head 34 is collector port 36. As herein illustrated, at FIG. 2, port 36 is sized to slidingly and frictionally engage nozzle end 37 of vacuum line 22. In this preferred embodiment, head 34 is formed in a somewhat hemispherical configuration, and collector port 36 is large in diameter when compared to the size of particles most commonly encountered during grinding operations and, as shown in FIG. 2, to wheel 30 as well.

As shown in FIGS. 1, 2, and 14, body 35 of hand nozzle 25 has gripping tabs 38 formed integrally therewith. In the preferred embodiment illustrated herein, four such tabs, arranged in opposed pairs, enable hand nozzle 25 to be snappingly fitted to body 31 of hand-held grinder 26. In this manner, hand nozzle 25 may be selectively removed from grinder 26, and reattached to another grinder, as required.

Figure 11:
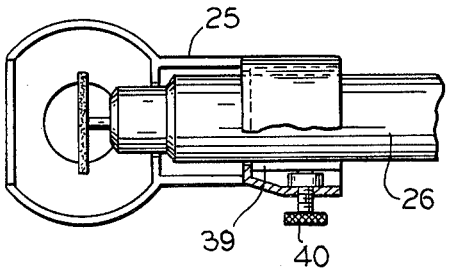
FIG. 11 is a partial sectional view of an additional embodiment of the hand nozzle shown in FIG. 2.
Figure 12:
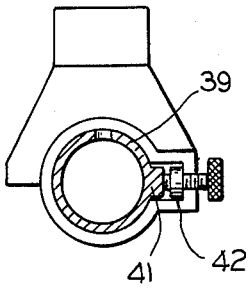
FIG. 12 is a view along line 12—12 of FIG. 11.

A second preferred embodiment of hand nozzle 24 is illustrated at FIGS. 11 and 12. This second preferred embodiment has been designed to enable hand nozzle 12 to be attached to hand-held grinders with body portions 31 of varying diameter. Grinders of different sizes may require nozzles with differently dimensioned gripping tabs, which would mean that a fully equipped shop having grinders of varying sizes would necessarily have to stock nozzles sized to fit the individual grinders. One manner in which this difficulty may be overcome is to provide a series of inexpensive sleeves, such as shown at 39 of FIG. 11 and FIG. 12. Such sleeves may be provided in various sizes, as required, and once snapped onto a hand-held grinder, the sleeve would have the effect of standardizing the grinder body diameter to fit a single size of hand nozzle.

In order to further provide for variations in dimension, and to provide firm attachment of hand nozzle 25, adjusting screw 40 may be provided to firmly grip sleeve 39 when hand nozzle 25 is attached to grinder 26. To achieve even more positive attachment and alignment, key 41 may be formed on sleeve 39, to mate with keyway 42 formed on hood 25. Adjusting screw 40 may be knurled, or otherwise modified to provide a firm, convenient grip for tightening and loosening.

Figure 3:
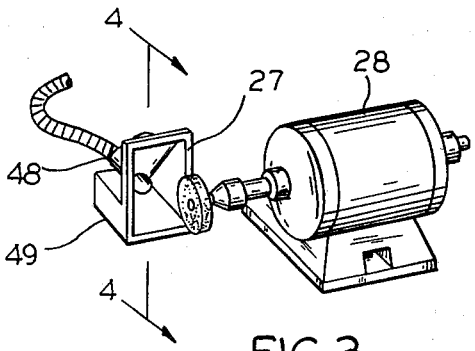
FIG. 3 is a partial perspective view illustrating use of the free-standing bench nozzle with a bench-type grinder.
Figure 4:
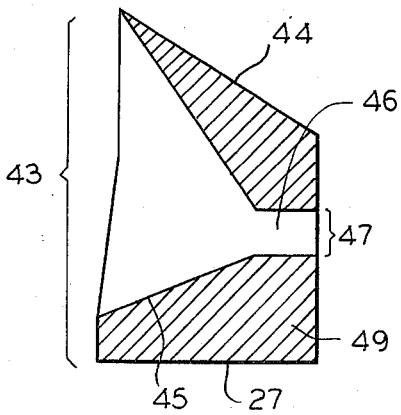
FIG. 4 is a sectional view along 4—4 of FIG. 3.

For bench grinding operations, bench nozzle 27 is provided as a portable, free-standing unit. As best seen in FIGS. 3 and 4, bench nozzle 27 has an oversized front opening 43 and a hollow interior with interior walls 44 and 45 tapering to a throat 46 which terminates in an exit port 47. During grinding operations, particles entering opening 43 are deflected by walls 44 and 45 toward throat 46. As illustrated in FIG. 3, the second end of vacuum line 22 has vacuum nozzle 48 formed thereon, sized to be tightly inserted through rear port 47. The vacuum created is at its most powerful at throat 46 and particles deflected thereto are readily drawn through port 47 and line 22 into cabinet 21.

One preferred embodiment of bench nozzle 27 is cast from aluminum, with a material distribution resulting in a heavier base area 49 for added stability. Bench nozzle 27 may thus be freely positioned with respect to bench grinder 28 to provide a maximum efficiency in particle collection.

Figure 15:
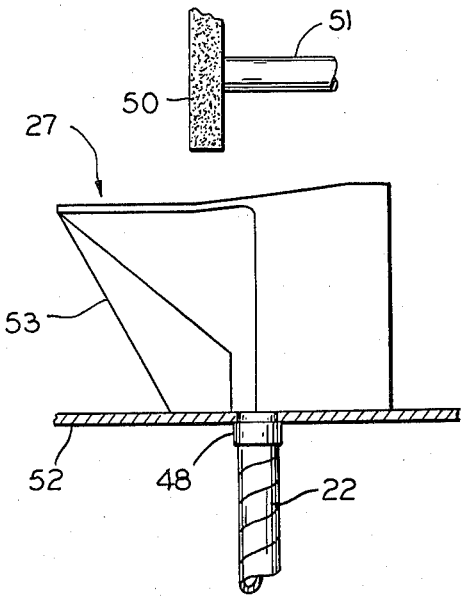
FIG. 15 illustrates use of the bench nozzle in a vertical collecting attitude.

As best illustrated in FIG. 15, bench nozzle 27 may also be vertically oriented to collect particles liberated by grinding element 50 mounted to shaft 51. As an example, bench nozzle 27 may be placed beneath grinding wheel 50 on bench surface 52, and a hole may be cut through bench surface 52 to accommodate vacuum supply line 22 and supply nozzle 48. As herein shown, reinforcing rib 53 provides added support and stability for use of nozzle 27 in a vertical position.

It should now be readily apparent that careful dimensioning of supply nozzle 48, collector port 36, and rear port 47 will enable supply line 22 to be selectively connected to either hand nozzle 25 or bench nozzle 27, as required. Thus, a single collector unit, with two collector nozzles may be used at a single station during both bench and hand grinding operations.

Cabinet 21 is divided generally into two comparments: a motor compartment 54 and a vacuum chamber 85. Motor compartment 54 is separated from vacuum chamber 85 by motor wall 55. Wall 55 has a circular passage cut therethrough such that air drawn by an electric motor (not shown) may be drawn through cabinet vacuum port 23, thus creating the vacuum in chamber 54.

Figure 8:
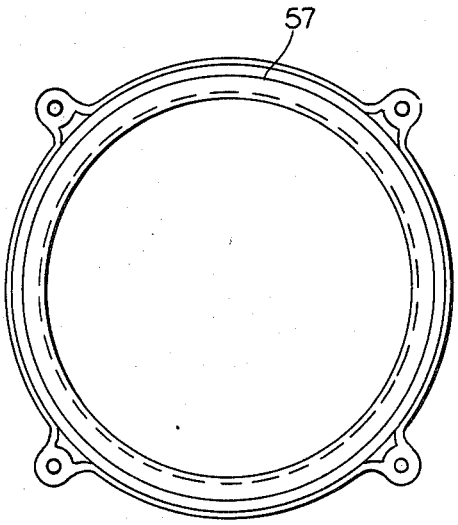
FIG. 8 is a front plan view of the motor filter assembly retainer.
Figure 9:
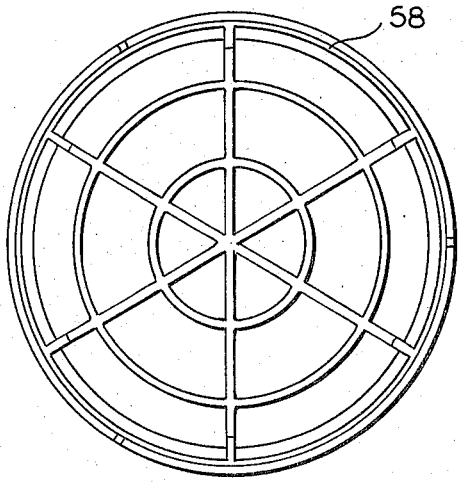
FIG. 9 is a front plan view of the filter grid.

As an added measure of protection for the unit's motor, a filter element 56 is positioned across the opening in motor wall 55. Filter element 56, supported by filter retaining ring 57 and retaining screen 58, as shown in FIGS. 8 and 9, may be of any conventionally known type, such as the polyurethane sheets commonly used in air conditioning and vacuum cleaner filters.

Figure 5:
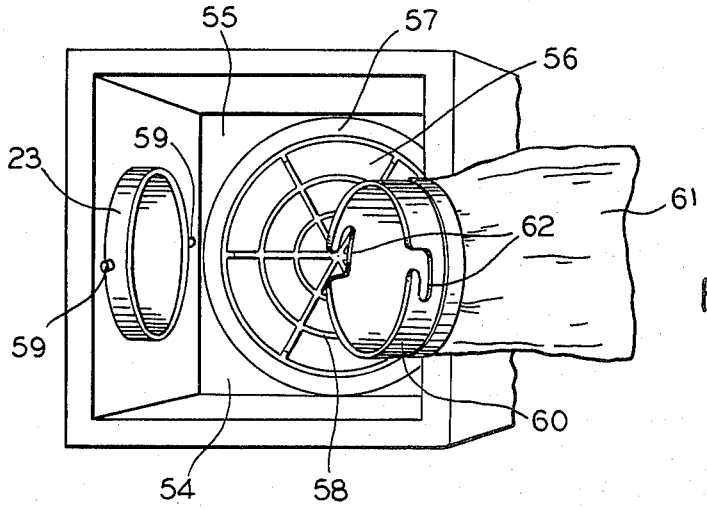
FIG. 5 is a partial perspective view illustrating attachment of the particle trap within the vacuum housing.

Particles intercepted by hand nozzle 25 or bench nozzle 27, and drawn by vacuum through vacuum supply line 22 are drawn into cabinet 21 through cabinet vacuum port 23, and are thereat trapped for eventual reclamation or disposal. In a preferred embodiment, cabinet vacuum port 23 extends into vacuum chamber 54, as shown in FIG. 5, and has pin projections 59 formed thereon. A preferred particle trap is also illustrated at FIG. 5, and includes a collar 60 to which a bag 61 is attached. Slotted cutouts 62 in collar 60 are shaped and sized to mate with pins 59. To mount bag 61 to vacuum port 23, pins 59 are aligned with the open portions of slot 62 and collar 60 is then rotated clockwise to engage pins 59 into the elongated portion of slot 62 until the bag is secured into position. Thereafter, particles entering through vacuum port 23 will enter bag 61 and will be therein retained. Bag 61 may be formed from any material found convenient to collect the particles liberated during grinding, but a preferred embodiment features a reusable bag of heavy cloth material, and a collar of metal for added rigidity needed to maintain the collar's shape.

Figure 6:
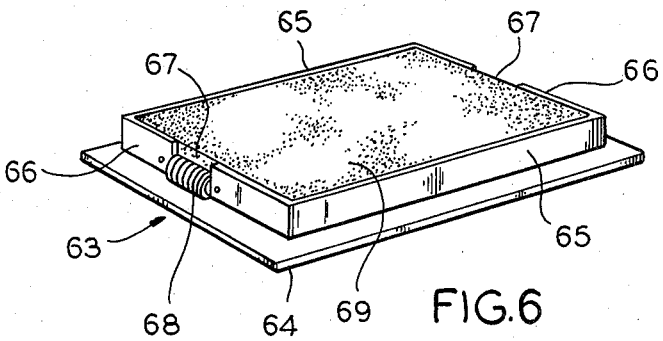
FIG. 6 is a perspective view of a side panel.

To provide access to vacuum chamber 54 and collection bag 61, cabinet 21 features a snapout end panel 63, shown in FIGS. 1 and 6. In a preferred embodiment, panel 63 includes an outer wall member 64, formed of stainless steel, to which wall segments 65 and 66 are attached, to form a rectangular recess. Walls 66 are interrupted, at 67, to accommodate springs 68. When panel 63 is positioned to close off cabinet 21, springs 68 contact the inside walls of cabinet 21 to maintain a friction fit. The panel may thus be removed to enable access to bag 61 without requiring the use of tools.

The recess formed by wall members 65 and 66 is filled with insulating material 69 which, in this embodiment, comprises a thin layer of lead foil sandwiched between layers of dense foam rubber. Such insulation has excellent sound absorbing properties and substantially reduces noise and vibration caused by the unit's electric motor.

Figure 13:
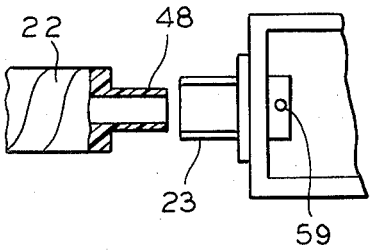
FIG. 13 is a partial section view illustrating attachment of the vacuum hose to the cabinet vacuum port.

As shown in FIG. 13, coupling 48 of vacuum supply line 22, in one preferred embodiment is shaped to closely fit within cabinet vacuum port 23, again providing a close, vacuum-tight fit without requiring the use of tools.

Figure 7:
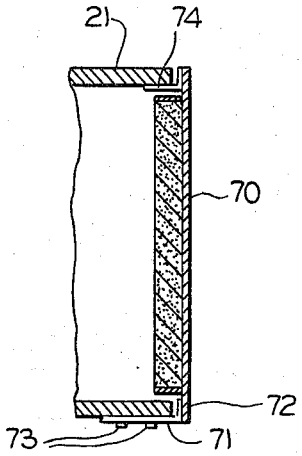
FIG. 7 is a partial sectional view along 7—7 of FIG. 1.

Drawing an efficient vacuum through vacuum supply hose 22 requires free and unrestricted air flow through cabinet 21 and motor compartment 85. Such air flow is also important to keep the motor from overheating during prolonged periods of operation. To facilitate such air flow, motor compartment end panel 70 is slightly spaced apart from cabinet 21, as best seen in FIG. 7, to form an airflow baffle. End panel 70 is held, along its lowermost edge by offset bracket 71, attached to end plate 70 at 72, and bolted or otherwise fastened to cabinet 21 at 73. Along its uppermost edge, end panel 70 is frictionally held to cabinet 21 by spring clip 74. Air passing through motor compartment 85 of cabinet 21 thus exits in a dispersed pattern, rather than a concentrated stream of air, through the peripherally extending outlet formed by cabinet 21, end plate 70 brackets 71, and clips 74. A preferred embodiment includes two brackets 71, positioned along the lowermost edge of plate 70, and two spring clips 74, positioned along the uppermost edge of plate 70.

Figure 10:
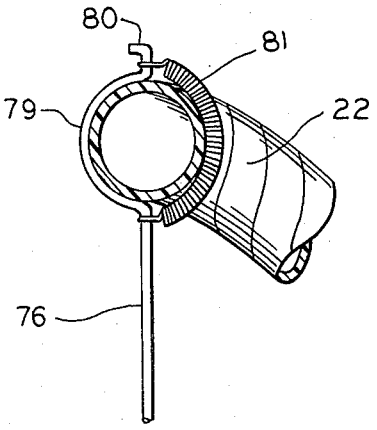
FIG. 10 is a detail of the vacuum line support assembly.

As best seen in FIGS. 1 and 10, hose support stand 75 provides a convenient means for holding supply hose 22 out of the way of a grinder operator. Spring stand 76 may be attached to bench 77 by clamp 78. At the uppermost segment of stand 76, concave segments 79 is shaped and sized to accommodate hose 22, while hook 80 provides an anchor point for retaining spring 81. Hose 22 is placed within concave segment 79, and retaining spring 81 is thereafter stretched over hose 22 and secured at hook 80. Stand 76 is of sufficient flexibility to allow the stand to flex or bend with movement of vacuum supply line 22.

In the embodiment herein illustrated, cabinet 21 is designed to be lightweight and portable in nature, and for that purpose, carrying handle 82 is provided. Collector 20 is further designed to operate on standard household current, thus enhancing its universality and portability. The unit is activated by rocker switch 83 on front panel 84, and the motor may be protected by any commonly known thermal electric fuse or circuit breaker.

Insulation of unit 20 is preferably provided throughout cabinet 21 to ensure quiet, vibration-free operation. A preferred form of insulation is of the dense foam/lead foil sandwich type, herein described above.

While the foregoing has presented specific selected embodiments of the invention, it is to be understood that these embodiments are presented by way of example only. It is expected that variations will be perceived which, although differing from the foregoing, do not depart from the spirit and scope of the invention, and that the invention described herein is intended to be limited only by the claims appended hereto.

What is claimed is:

1. In an apparatus for intercepting and collecting particles debrided during use of a hand-held grinder, said apparatus of the type having a vacuum line communicating at one end with a source of vacuum within a cabinet and, at the other end; with a collector, said grinder of the type having a grinding wheel rotating about an axis, the improvement comprising:

a hood formed on said collector, an exit port formed on said hood at right angles to said axis of rotation of said grinding wheel, said exit port being substantially larger in diameter than the thickness of said grinding wheel, said hood shaped to position said port proximate said grinding wheel, said vacuum line attachable to said hood at said exit port, whereby particles intercepted by said collector are drawn therethrough to said cabinet;

a body integral with said hood; and means to removably attach said body to said grinder.

2. The apparatus as recited in claim 1 wherein said cabinet means includes at least two compartments, said first of said compartments having an electric fan and motor disposed therewithin, said electric fan and motor adapted to exhaust air from said first compartment, said first compartment communicating with a second of said compartments, to thereby create a partial vacuum in said second compartment when said air is exhausted, said first compartment closed off by a solid end panel, said end panel joined to said cabinet by two or more brackets, said brackets holding said end panel spaced apart from said cabinet, said cabinet and said end panel defining therebetween a baffle extending peripherally about the end of said first compartment through which air may be exhausted from said first compartment by said electric fan and motor.

3. The apparatus as recited in claim 1 including means to hold said collector to one said hand-held grinder, said holding means including at least one hollow sleeve, said sleeve being dimensioned to closely approximate the diameter of a selected one of said hand-held grinders, said sleeve being positionable on said grinder, said collector being attachable to said sleeve when said sleeve is positioned on said hand-held grinder, and means to adjustably tighten said collector onto said sleeve when said sleeve is positioned on said hand-held grinder.

4. The apparatus as recited in claim 1 wherein said hood has oppositely disposed tabs formed integrally on said body, said tabs shaped to clampingly accommodate one said hand-held grinder therebetween in a friction fit.

5. In an apparatus for intercepting and collecting particles debrided during use of a hand-held grinder, and bench type grinders, said apparatus of the type having a vacuum line communicating at one end with a source of vacuum within a cabinet, and at the other end with a collector, said grinder of the type having a grinding wheel rotating about an axis, the improvement comprising:

said collector being free-standing and having a front face and a rear wall, a passage communicating through said collector from said front face through said rear wall, a first portion of said passage being defined by upper, lower and lateral inner wall segments, said inner wall segments tapering from said front face toward said rear wall to define said cavity as pyramidal, with the apex of said pyramidal cavity extending toward said rear wall, a second portion of said passage defined by segments of said rear wall forming a cylindrical duct extending from said apex through said rear wall;

said cylindrical duct attachable to said vacuum line whereby a partial vacuum may be created within said cavity, said collector being freely positionable proximate said grinding elements to intercept particles debrided by said hand-held grinders or said bench type grinders whereby particles intercepted by said collector are drawn through said passage to said vacuum line and thereby to said cabinet.

6. The apparatus as recited in claim 5 wherein said cabinet has at least two compartments, said first of said compartments having an electric fan and motor disposed therewithin, said electric fan and motor adapted to exhaust air from said first compartment, said first compartment communicating with a second of said compartments, to thereby create a partial vacuum in said second compartment when said air is exhausted, said first compartment closed off by a solid end panel, said end panel joined to said cabinet by two or more brackets, said brackets holding said end panel spaced apart from said cabinet, said cabinet and said end panel defining therebetween a baffle extending peripherally about the end of said first compartment through which air may be exhausted from said first compartment by said electric fan and motor.

* * * * *